US006517127B1

(12) United States Patent
Lu et al.

(10) Patent No.: US 6,517,127 B1
(45) Date of Patent: Feb. 11, 2003

(54) ELECTRIC DOOR LOCK

(76) Inventors: Chao-Jung Lu, 13F, No. 199-1, Kuang-Fu N. Rd., Sung-Shan Dist., Taipei City (TW); Yung-Chen Lin, 3F, No. 27, Jen-Yi-Hsin-Tsun, Tung Dist., Chia-Yi City (TW)

( * ) Notice: Subject to any disclaimer, the term of this patent is extended or adjusted under 35 U.S.C. 154(b) by 0 days.

(21) Appl. No.: 09/957,699

(22) Filed: Sep. 17, 2001

(51) Int. Cl.[7] ..... E05C 1/06

(52) U.S. Cl. ..... 292/144; 70/223; 70/280; 292/142

(58) Field of Search ..... 292/144, 142, 292/336.3, DIG. 27; 70/280, 281, 282, 223, 217

(56) References Cited

U.S. PATENT DOCUMENTS 4,438,962 A * 3/1984 Soloviff et al. ..... 292/144
5,516,161 A * 5/1996 Mader et al. ..... 292/34
5,531,086 A * 7/1996 Bryant ..... 70/279
5,857,365 A * 1/1999 Armstrong ..... 70/279
6,012,310 A * 1/2000 Hsiao ..... 70/278.2
6,062,612 A * 5/2000 Lin ..... 292/144
6,089,058 A * 7/2000 Elpern et al. ..... 70/279.1
6,382,005 B1 * 5/2002 White et al. ..... 70/277
6,406,072 B1 * 6/2002 Chen ..... 292/144

* cited by examiner

*Primary Examiner*—J. J. Swann
*Assistant Examiner*—Dinesh N Melwani
(74) *Attorney, Agent, or Firm*—Darby & Darby

(57) ABSTRACT

In an electric door lock, a spindle with a manually operable rotary knob is connected operably to a dead bolt, and has a spindle coupling plate sleeved non-rotatably thereon, and a gear plate unit sleeved rotatably thereon. The spindle coupling plate is provided with a ball member which is biased to project from the spindle coupling plate and engage one of a plurality of angularly displaced ball recesses formed in the gear plate unit. An electric driving motor has a transmission shaft engaging the gear plate unit. The ball member disengages the spindle coupling plate from the gear plate unit when the rotary knob is operated to rotate the spindle and the spindle coupling plate. The motor is operable to rotate the gear plate unit which rotates the spindle coupling plate by virtue of the engagement between the ball member and the ball recesses, thereby resulting in co-rotation of the spindle.

2 Claims, 6 Drawing Sheets

ELECTRIC DOOR LOCK

BACKGROUND OF THE INVENTION

1. Field of the Invention

The present invention relates to an electric door lock, more particularly to an electric door lock which is operable both manually and electrically.

2. Description of the Related Art

Electric door locks are known in the art. A conventional electric door lock generally includes an electric motor with a transmission shaft coupled to a spindle which is connected operably to a latch bolt. By operating the electric motor, the spindle is rotated to move the latch bolt between locking and unlocking positions. On the other hand, a conventional manually operable door lock is known to include a lock body having a manual operating portion and a key-operated lock unit which are operable for rotating a spindle, and a latch bolt connected operably to the spindle. By operating the manual operating portion or by operating the lock unit with the corresponding key, the spindle can be rotated to move the latch bolt between locking and unlocking positions.

In Applicant's co-pending U.S. patent application Ser. No. 09/698,540, filed on Oct. 27, 2000, there is disclosed an electric door lock that is operable both electrically and manually so as to provide added convenience to the user.

SUMMARY OF THE INVENTION

The object of the present invention is to provide an electric door lock that is operable both electrically and manually.

Accordingly, the electric door lock of the present invention includes a lock housing, a deadbolt, a manual operating member, a spindle coupling plate, a gear plate unit, a clutch unit, an electric driving motor, an electric switch unit, and a switch actuator. The deadbolt is mounted in the lock housing, and is movable between locking and unlocking positions. The manual operating member is mounted on the lock housing, and has a deadbolt operating spindle extending into the lock housing and connected operably to the deadbolt, and a manually operable rotary knob secured to one end of the spindle and disposed externally of the lock housing. The spindle coupling plate is sleeved on the spindle so as to be co-rotatable therewith. The spindle coupling plate has a first side face. The gear plate unit is sleeved rotatably on the spindle, and is disposed adjacent to the spindle coupling plate. The gear plate unit has a second side face which confronts the first side face of the spindle coupling plate. The gear plate unit further has a peripheral edge formed with a set of transmission teeth. The clutch unit is provided on the first and second side faces, and includes a plurality of ball recesses which are formed in the second side face of the gear plate unit and which are angularly displaced from each other by a predetermined angle with respect to the axis of the spindle. The clutch unit further includes a ball member provided on the spindle coupling plate, and a biasing spring for biasing the ball member to project from the first side face of the spindle coupling plate for engaging one of the ball recesses. The electric driving motor has a transmission shaft coupled to the transmission teeth of the gear plate unit. The rotary knob is operable so as to rotate the spindle by the predetermined angle about the axis of the spindle for moving the deadbolt between the locking and unlocking positions. The ball member is retracted from said one of the ball recesses and moves toward the spindle coupling plate against biasing action of the spring when the spindle is rotated to result in corresponding rotation of the spindle coupling plate relative to the gear plate unit. The ball member projects from the first side face, and extends into another one of the ball recesses when the spindle coupling plate is rotated with the spindle by the predetermined angle to align the ball member with said another one of the ball recesses. The electric driving motor is operable to drive rotation of the gear plate unit so as to cause corresponding rotation of the spindle coupling plate by virtue of the engagement between the ball member and said one of the ball recesses, thereby rotating the spindle for moving the deadbolt between the locking and unlocking positions. The electric switch unit is mounted in the housing adjacent to the spindle coupling plate, and is connected electrically to the electric driving motor. The switch actuator is provided on the spindle coupling plate for co-rotation therewith. The switch actuator projects in a radial direction with respect to the axis of the spindle, is movable with the spindle coupling plate relative to the electric switch unit, and enables the electric switch unit to control operation of the electric driving motor in a manner that the electric driving motor drives rotation of the spindle by the predetermined angle when the electric driving motor is operated.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
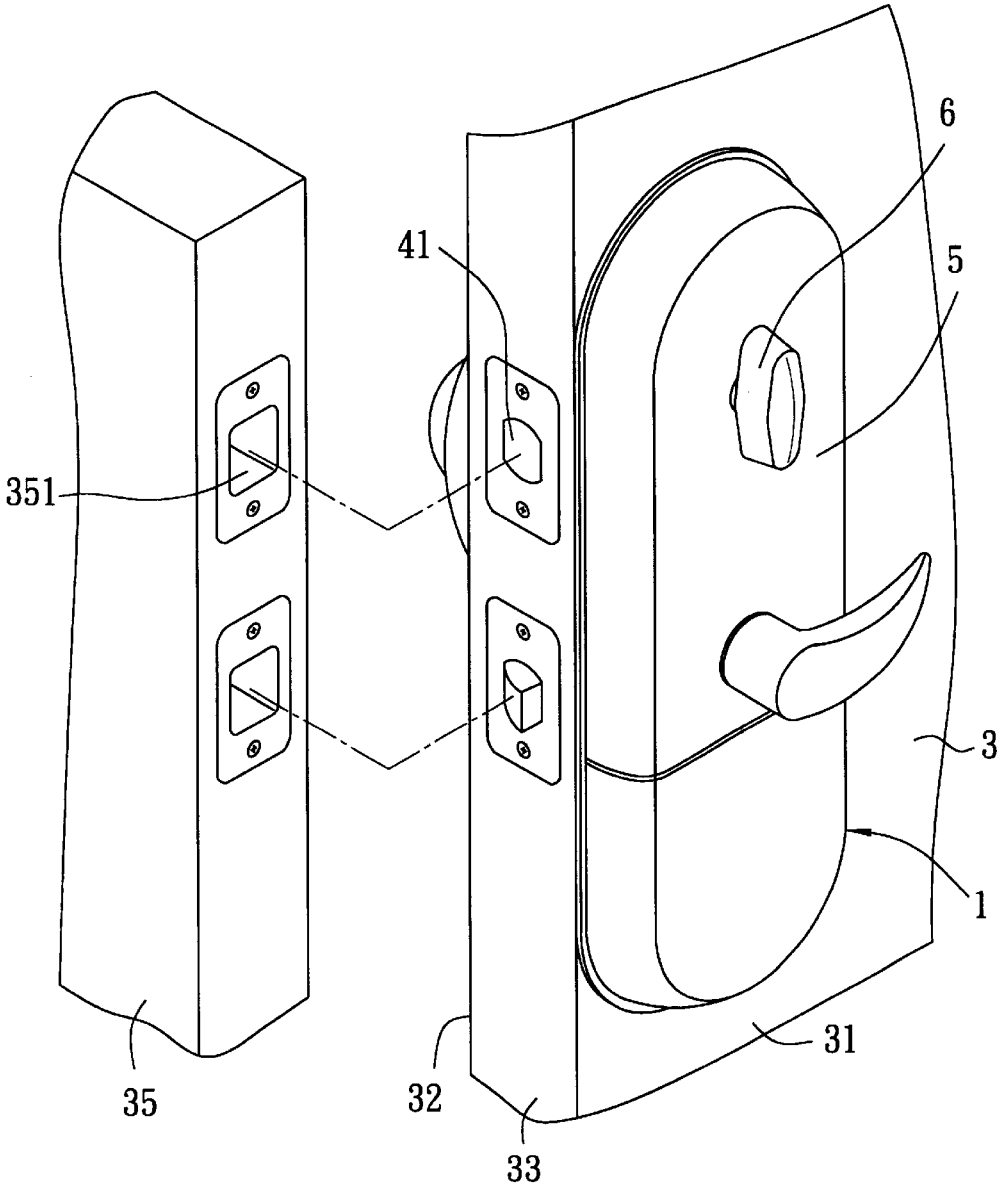
FIG. 1 is a perspective view illustrating a preferred embodiment of an electric door lock according to the present invention when installed on a door.

Referring to FIG. 1, the preferred embodiment of the electric door lock 1 of the present invention is adapted to be installed on a door panel 3 which is mounted pivotally on a door frame 35. The door panel 3 has an inner side wall 31, an outer side wall 32 and a peripheral edge wall 33 interconnecting the inner and outer side walls 31, 32

Figure 2:
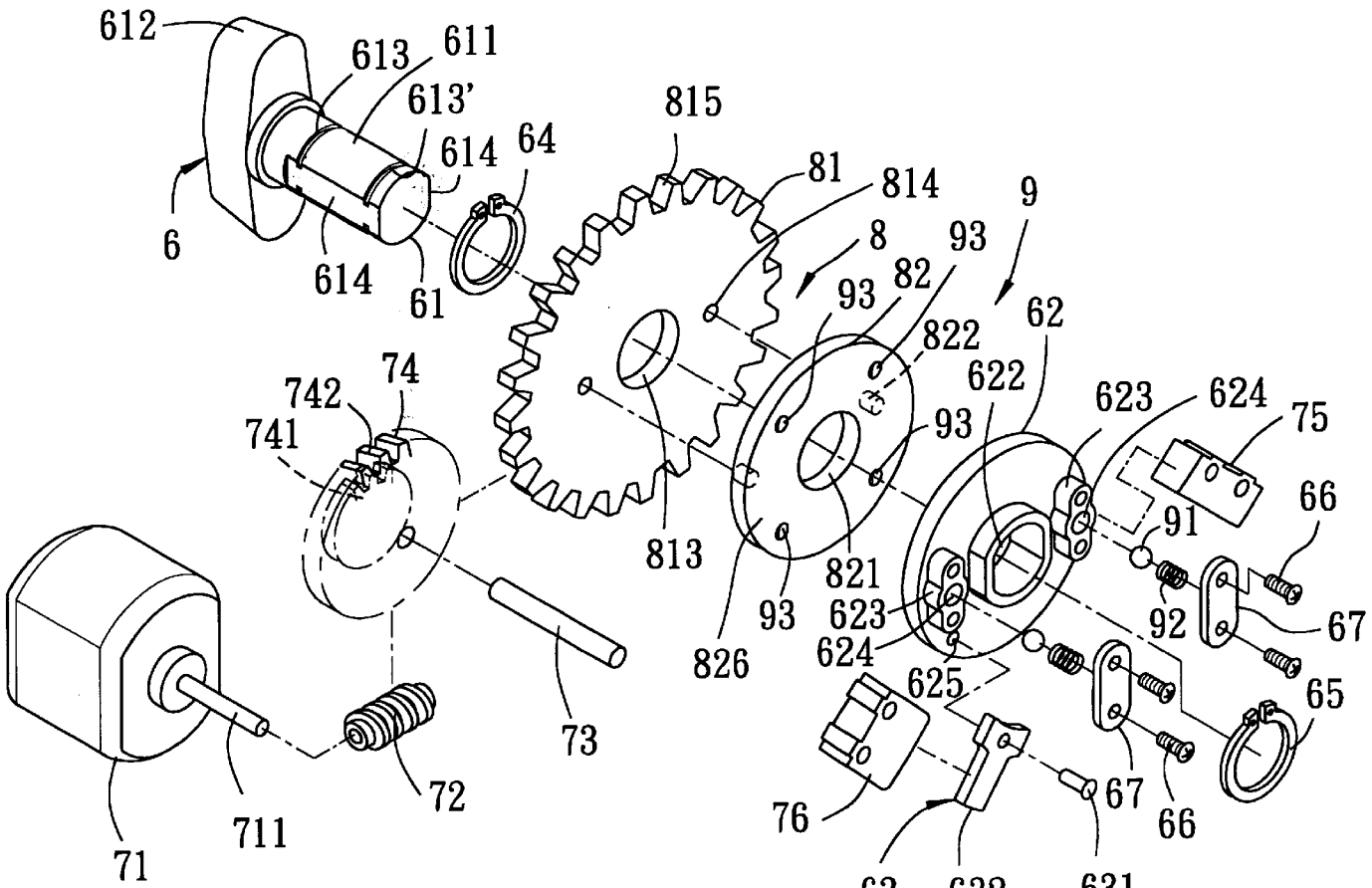
FIG. 2 is an exploded perspective view of the preferred embodiment, where a lock housing and a deadbolt are removed for the sake of clarity.
Figure 3:
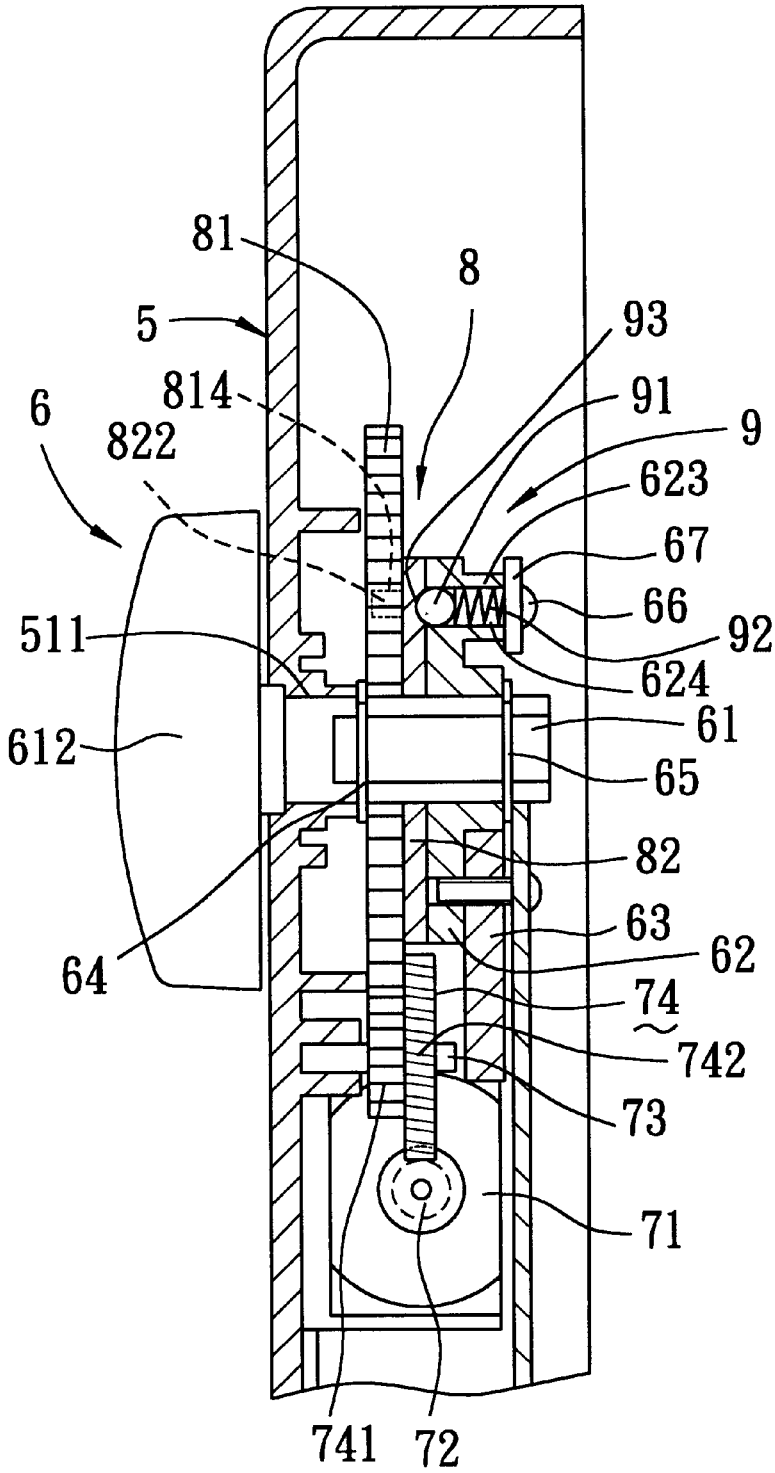
FIG. 3 is a sectional view of the preferred embodiment.
Figure 4:
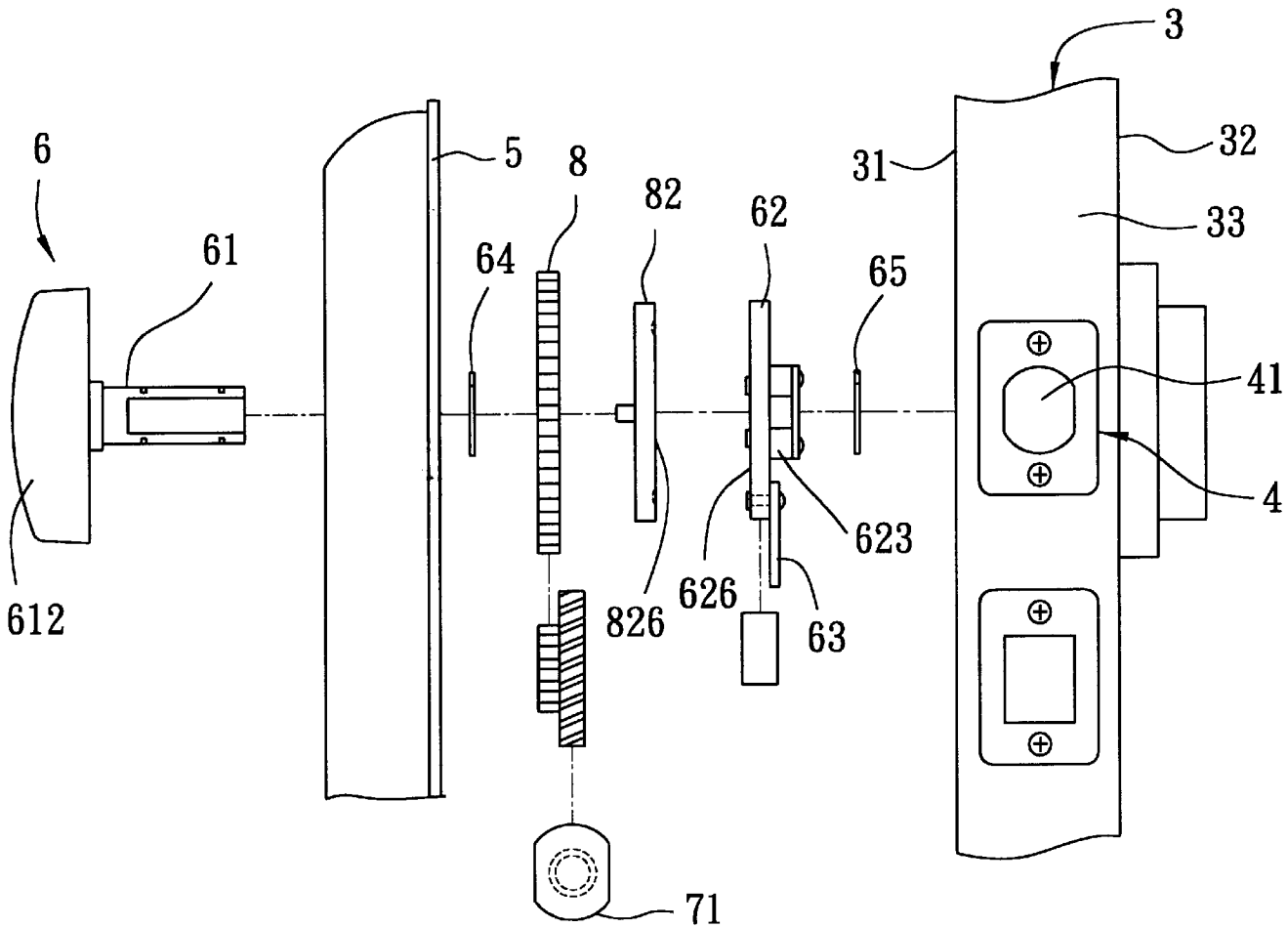
FIG. 4 is a partly exploded schematic side view of the preferred embodiment.

Referring to FIGS. 2 to 4, the electric door lock 1 of the preferred embodiment is shown to include a lock housing 5, a deadbolt 41, a manual operating member 6, a spindle coupling plate 62, a gear plate unit 8, a clutch unit 9, an electric driving motor 71, an electric switch unit including a locking switch member 75 and an unlocking switch member 76, and a switch actuator 63.

The lock housing 5 is adapted to be mounted on the door panel 3 and has the deadbolt 41 mounted therein. The deadbolt 41 is operable to move between a locking position, in which the deadbolt 1 projects from the peripheral edge wall 33 of the door panel 3 and is adapted to extend into a deadbolt hole 351 formed in the door frame 35, and an unlocking position, in which the deadbolt 41 is retracted into the peripheral edge wall 33 of the door panel 3. The manual operating member 6 is mounted on the lock housing 5, and is disposed adjacent to the inner side wall 31 of the door panel 3. The manual operating member 6 has a deadbolt operating spindle 61 which extends through a spindle hole 511 formed in the lock housing 5 and into an interior of the lock housing 5, and which is connected operably to the deadbolt 41 in a known manner for moving the deadbolt 41 between the locking and unlocking positions. The spindle 61 has two diametrically opposite flat surfaces 614, and two diametrically opposite curved surfaces 611 interconnecting the flat surfaces 614 so as to provide the spindle 61 with a symmetrical and non-circular cross-section. The curved surfaces 611 are formed with first and second retaining grooves 613, 613' which are displaced from each other in the longitudinal direction of the spindle 61 for engaging first and second retaining rings 64, 65, respectively. The manual operating member 6 further includes a manually operable rotary knob 612 secured to one end of the spindle 61 and disposed externally of the lock housing 5. The rotary knob 612 is operable for rotating the spindle 61 so as to move the deadbolt 41 between the locking and unlocking positions.

The gear plate unit 8 includes a circular gear member 81 and a ball engaging plate 82 which are sleeved rotatably on the spindle 61. The spindle coupling plate 62 is sleeved on the spindle 61 adjacent to the ball engaging plate 82. The gear member 81, the ball engaging plate 82 and the spindle coupling plate 62 are retained on the spindle 61 by means of the first and second retaining rings 64, 65. The spindle coupling plate 62 has a first side face 626 confronting a second side face 826 of the ball engaging plate 82.

The gear member 81 has a circular central spindle hole 813 which permits the spindle 61 to extend rotatably therethrough, and an annular peripheral edge formed with a set of first transmission teeth 815 that are arranged around the gear member 81. The ball engaging plate 82 is similarly formed with a circular central spindle hole 821 to permit the spindle 61 to extend rotatably therethrough. The ball engaging plate 82 is disposed between the gear member 81 and the spindle coupling plate 62, and is fastened to the gear member 81 by means of a pair of pin projections 822 that project from the gear member 81 and that engage respectively a pair of pin holes 814 formed in the gear member 81. The second side face 826 of the ball engaging plate 82 is formed with four ball recesses 93, which are angularly displaced from one another with respect to an axis of the spindle 61. In the present embodiment, each of the ball recesses 93 is displaced from an adjacent one of the ball recesses 93 by an angle of 90 degrees, such that the ball recesses 93 can be grouped into two diametrically opposite pairs.

The spindle coupling plate 62 is formed with a non-circular spindle coupling hole 622 conforming to the cross-section of the spindle 61 for coupling co-rotatably with the spindle 61. The spindle coupling plate 62 is further formed with a pair of diametrically opposite ball seats 623, each of which is formed with a ball cavity 624 for receiving a ball member 91 and a biasing spring 92. A cap 67 is fastened to a respective one of the ball seats 623 using two screws 66 for closing one end of the ball cavity 624 of the respective ball seat 623. The ball cavity 624 opens in the first side face 626. The springs 92, which are received in the ball cavities 624 of the ball seats 623, bias the ball members 91 to project from the first side face 626 of the spindle coupling plate 62 for engaging an aligned pair of the ball recesses 93. The ball members 91, the springs 92 and the ball recesses 93 cooperatively serve as a clutch unit for releasably locking the spindle coupling plate 62 to the ball engaging plate 82.

The switch actuator 63 is fastened to the spindle coupling plate 62 using a fastening pin 631 that is inserted into a pin hole 625 in the spindle coupling plate 62, and has an actuating projection 632 that projects radially from the spindle coupling plate 62.

The locking and unlocking switch members 75, 76, each of which is in the form of an optoelectric switch in the present embodiment, are mounted on the lock housing adjacent to the spindle coupling plate 62. In the present embodiment, the locking and unlocking switch members 75, 76 are spaced apart by an angle of about 90 degrees with respect to an axis of the spindle 61.

The electric driving motor 71 is mounted in the lock housing 5, and is connected electrically to the locking and unlocking switch members 75, 76. The electric driving motor 71 has a transmission shaft 711. A worm gear 72 is secured to the transmission shaft 711 such that the former is rotatable about an axis of the latter during operation of the electric driving motor 71. A is transmission gear 74 is mounted rotatably in the lock housing 5 by means of a gear axle 73 parallel to the spindle 61 and perpendicular to the transmission shaft 711. The transmission gear 74 is disposed between the worm gear 72 and the gear member 81, and is formed with a set of second transmission teeth 742 to engage the worm gear 72, and a set of third transmission teeth 741 to engage the first transmission teeth 815 of the gear member 81, thereby transmitting rotation of the worm gear 72 to the gear member 81.

The electric door lock 1 of the present invention can be operated by rotating manually the rotary knob 612, or by operating electrically the electric driving motor 71.

Figure 5:
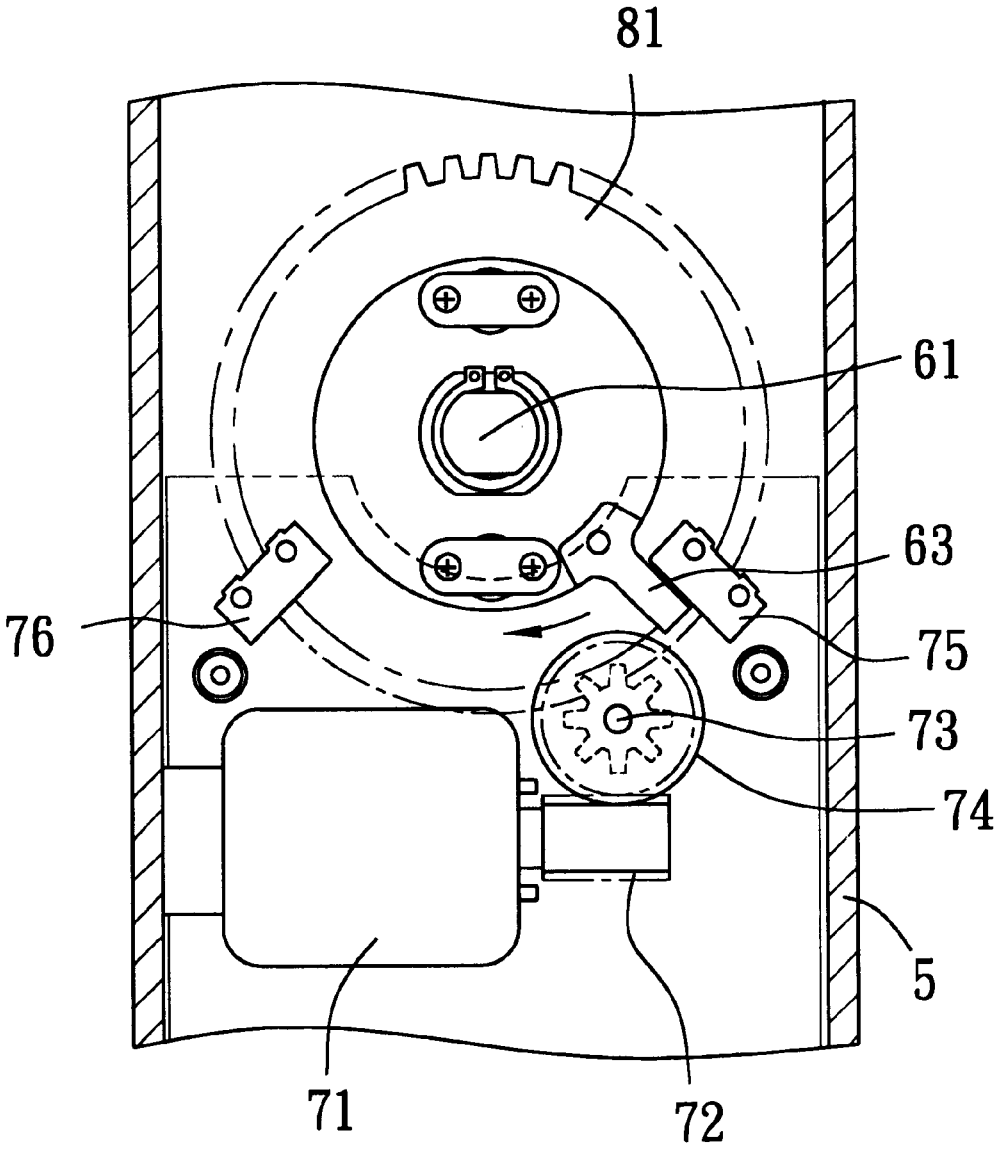
FIG. 5 is a fragmentary schematic view illustrating the preferred embodiment in a locking state.
Figure 6:
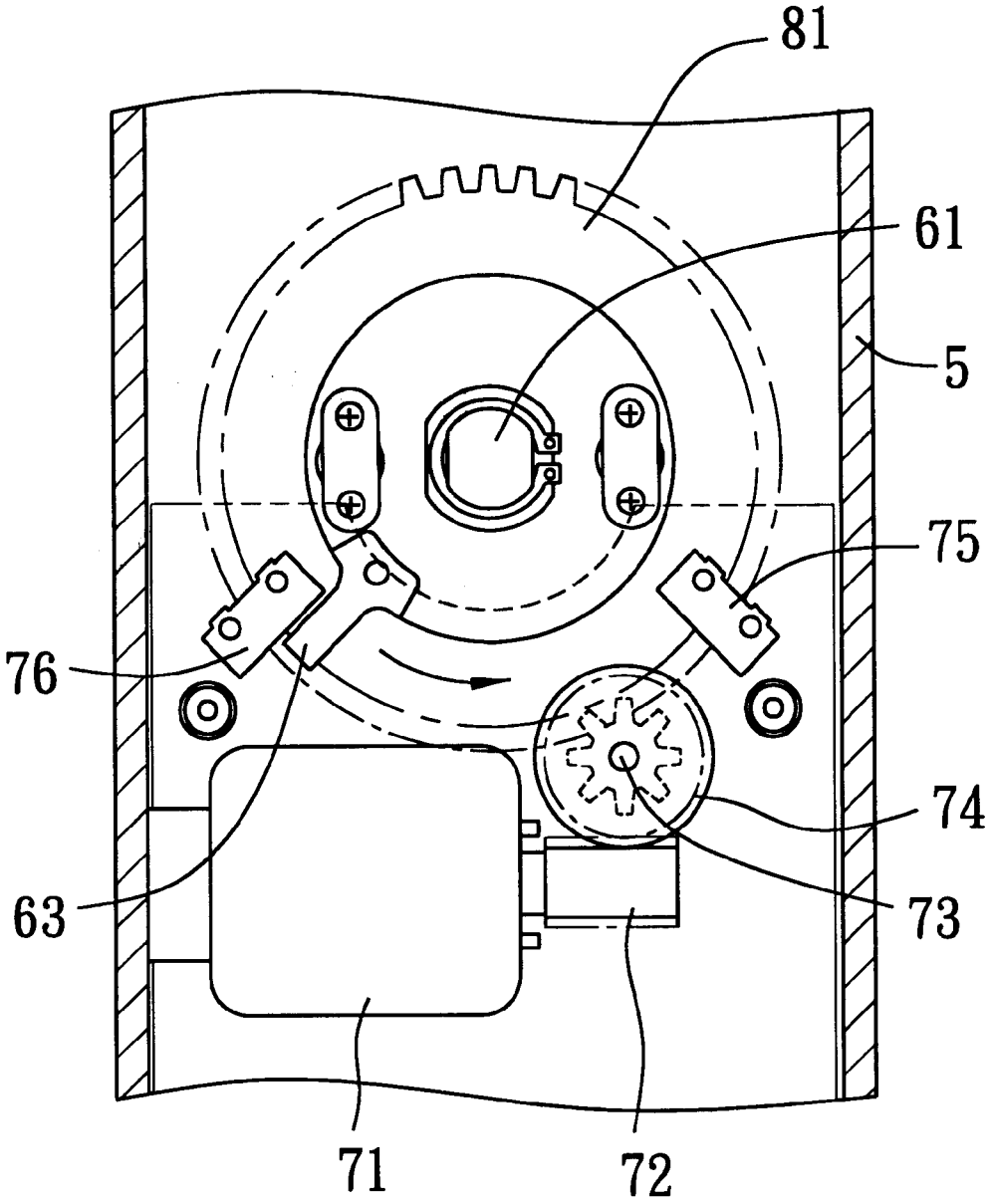
FIG. 6 is a fragmentary schematic view illustrating the preferred embodiment in an unlocking state.

Referring to FIGS. 2 to 4, when the electric door lock 1 of the present embodiment is in a locking state, the switch actuator 63 is disposed proximate to the locking switch member 75, as shown in FIG. 5. When it is desired to operate the electric door lock 1 manually for unlocking the same, the rotary knob 612 is rotated manually to rotate the spindle 61 for moving the deadbolt 41 (see FIG. 1) from the locking position to the unlocking position. The spindle coupling plate 62 is thus rotated together with the spindle 61. Since the gear member 81 engages the transmission gear 74, which, in turn, engages the worm gear 72, and since the worm gear 72 is stationary at this time because the electric driving motor 71 is not operated, the gear member 81 and the ball engaging plate 82 are stationary and do not rotate with the spindle coupling plate 62. As such, the ball members 91 are retracted into the ball cavities 624 against biasing actions of the springs 92 to disengage from the initial aligned pair of the ball recesses 93, thereby preventing the gear plate unit 8 from hindering rotation of the spindle coupling plate 62 and rotation of the spindle 61 for operating the deadbolt 41. When the spindle 61 has been rotated by a predetermined angle, such as 90 degrees in the present embodiment, the ball members 91 are aligned respectively with another pair of the ball recesses 93 in the ball engaging plate 82. The springs 92 expand to bias the ball members 91 respectively into said another pair of the ball recesses 93 so as to once again engage the spindle coupling plate 62 with the ball engaging plate 82. At this time, the deadbolt 41 is moved to the unlocking position, and the switch actuator 63 is disposed adjacent to the unlocking switch member 76, as shown in FIG. 6.

Likewise, to operate the electric door lock 1 manually for locking the same, the rotary knob 612 is rotated in an opposite direction for moving the deadbolt 41 from the unlocking position to the locking position. It is noted that, during manual operation of the electric door lock 1 of the present invention for moving the deadbolt 41 between the locking and unlocking positions, the switch actuator 63 moves between the locking and unlocking switch members 75, 76 without actuating the locking and unlocking switch members 75, 76 since the electric driving motor 71 is not operated at this time.

To operate the electric door lock 1 of the present embodiment electrically for unlocking the same when the electric door lock 1 is initially in the locking state, in which the switch actuator 63 is disposed adjacent to the locking switch member 75, the electric driving motor 71 is operated, such as by a remote controller (not shown), to enable rotation of the worm gear 72 and the transmission gear 74, which, in turn, rotates the gear member 81 and the ball engaging plate 82 attached to the gear member 81. Due to the engagement between the ball members 92 and the ball recesses 93, the spindle coupling plate 62 is rotated with the ball engaging plate 82 to cause co-rotation of the spindle 61 for moving the deadbolt 41 and to cause corresponding movement of the switch actuator 63 with the spindle coupling plate 62. When the spindle 61 is rotated by a predetermined angle, such as 90 degrees in the present embodiment, the actuating projection 632 of the switch actuator 63 is moved adjacent to the unlocking switch member 76, as shown in FIG. 6. Upon sensing the actuating projection 632, the unlocking switch member 76 is actuated to provide an electric signal to the electric driving motor 71 for deactivating the same, thereby positioning the deadbolt 41 in the unlocking position. Likewise, to move the deadbolt 41 from the unlocking position to the locking position, the electric driving motor 71 is operated to rotate the transmission shaft 711 and the worm gear 72 in an opposite direction. The locking switch member 75 operates in a manner similar to that of the unlocking switch member 76 for deactivating the electric driving motor 71.

When the deadbolt 41 is replaced with one having a different backset length, the switch actuator 63 may be replaced with one having a larger width, measured in a circumferential direction with respect to the axis of the spindle 61. For instance, when the switch actuator 63 is replaced with a wider one, the spindle 61 rotates by a smaller angle to enable sensing of the switch actuator 63 by the locking or unlocking switch members 75, 76. In another embodiment of the present invention, the switch actuator 63 may be formed integrally on the spindle coupling plate 62. Instill another embodiment, the ball recesses 93 may be formed directly on one side surface of the gear member 81, and the ball engaging plate 82 may be omitted.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An electric door lock comprising:

a lock housing;

a deadbolt mounted in said lock housing and movable between locking and unlocking positions;

a manual operating member mounted on said lock housing and having a deadbolt operating spindle extending into said lock housing and connected operably to said deadbolt, and a manually operable rotary knob secured to one end of said spindle and disposed externally of said lock housing, said spindle having an axis;

a spindle coupling plate sleeved on said spindle so as to be co-rotatable therewith, said spindle coupling plate having a first side face;

a gear plate unit sleeved rotatably on said spindle and disposed adjacent to said spindle coupling plate, said gear plate unit having a second side face which confronts said first side face of said spindle coupling plate, said gear plate unit further having a peripheral edge formed with a set of transmission teeth;

a clutch unit provided on said first side face and said second side face, said clutch unit including a plurality of ball recesses which are formed in said second side face of said gear plate unit and which are angularly displaced from each other by a predetermined angle with respect to the axis of said spindle, said clutch unit further including a ball member provided on said spindle coupling plate, and a biasing spring for biasing said ball member to project from said first side face of said spindle coupling plate for engaging one of said ball recesses;

an electric driving motor having a transmission shaft coupled to said transmission teeth of said gear plate unit;

said rotary knob being operable so as to rotate said spindle by the predetermined angle about the axis of said spindle for moving said deadbolt between said locking and unlocking positions, said ball member being retracted from said one of said ball recesses and moving toward said spindle coupling plate against biasing action of said spring when said spindle is rotated to result in corresponding rotation of said spindle coupling plate relative to said gear plate unit, said ball member projecting from said first side face and extending into another one of said ball recesses when said spindle coupling plate is rotated with said spindle by the predetermined angle to align said ball member with said another one of said ball recesses;

said electric driving motor being operable to drive rotation of said gear plate unit so as to cause corresponding rotation of said spindle coupling plate by virtue of the engagement between said ball member and said one of said ball recesses, thereby rotating said spindle for moving said deadbolt between said locking and unlocking positions;

an electric switch unit mounted in said housing adjacent to said spindle coupling plate and connected electrically to said electric driving motor; and a switch actuator provided on said spindle coupling plate for co-rotation therewith, said switch actuator projecting in a radial direction with respect to the axis of said spindle, said switch actuator being movable with said spindle coupling plate relative to said electric switch unit and enabling said electric switch unit to control operation of said electric driving motor in a manner that said electric driving motor drives rotation of said spindle by the predetermined angle when said electric driving motor is operated;

wherein said gear plate unit includes a gear member sleeved rotatably on said spindle and formed with said transmission teeth, and a ball engaging plate formed with said second side face and said ball recesses, said ball engaging plate being sleeved rotatably on said spindle adjacent to said gear member and being fastened to said gear member so as to be co-rotatable therewith about the axis of said spindle.

2. An electric door lock comprising:

a lock housing;

a deadbolt mounted in said lock housing and movable between locking and unlocking positions;

a manual operating member mounted on said lock housing and having a deadbolt operating spindle extending into said lock housing and connected operably to said deadbolt, and a manually operable rotary knob secured to one end of said spindle and disposed externally of said lock housing, said spindle having an axis;

a spindle coupling plate sleeved on said spindle so as to be co-rotatable therewith, said spindle coupling plate having a first side face;

a gear plate unit sleeved rotatably on said spindle and disposed adjacent to said spindle coupling plate, said gear plate unit having a second side face which confronts said first side face of said spindle coupling plate, said gear plate unit further having a peripheral edge formed with a set of transmission teeth;

a clutch unit provided on said first side face and said second side face, said clutch unit including a plurality of ball recesses which are formed in said second side face of said gear plate unit and which are angularly displaced from each other by a predetermined angle with respect to the axis of said spindle, said clutch unit further including a ball member provided on said spindle coupling plate, and a biasing spring for biasing said ball member to project from said first side face of said spindle coupling plate for engaging one of said ball recesses;

an electric driving motor having a transmission shaft coupled to said transmission teeth of said gear plate unit;

said rotary knob being operable so as to rotate said spindle by the predetermined angle about the axis of said spindle for moving said deadbolt between said locking and unlocking positions, said ball member being retracted from said one of said ball recesses and moving toward said spindle coupling plate against biasing action of said spring when said spindle is rotated to result in corresponding rotation of said spindle coupling plate relative to said gear plate unit, said ball member projecting from said first side face and extending into another one of said ball recesses when said spindle coupling plate is rotated with said spindle by the predetermined angle to align said ball member with said another one of said ball recesses;

said electric driving motor being operable to drive rotation of said gear plate unit so as to cause corresponding rotation of said spindle coupling plate by virtue of the engagement between said ball member and said one of said ball recesses, thereby rotating said spindle for moving said deadbolt between said locking and unlocking positions;

an electric switch unit mounted in said housing adjacent to said spindle coupling plate and connected electrically to said electric driving motor; and a switch actuator provided on said spindle coupling plate for co-rotation therewith, said switch actuator projecting in a radial direction with respect to the axis of said spindle, said switch actuator being movable with said spindle coupling plate relative to said electric switch unit and enabling said electric switch unit to control operation of said electric driving motor in a manner that said electric driving motor drives rotation of said spindle by the predetermined angle when said electric driving motor is operated;

said clutch unit including two of said ball members and two of said biasing springs for respectively biasing said ball members to project from said first side face and engage two of said ball recesses; wherein said ball members are diametrically opposite to each other with respect to the axis of said spindle.

* * * * *